US006021898A

United States Patent [19]

Sutherland

[11] Patent Number: 6,021,898

[45] Date of Patent: Feb. 8, 2000

[54] WRAP-AROUND ARTICLE CARRIER

[75] Inventor: Robert L. Sutherland, Kennesaw, Ga.

[73] Assignee: Riverwood International Corporation, Atlanta, Ga.

[21] Appl. No.: 09/243,993

[22] Filed: Feb. 3, 1999

[51] Int. Cl.[7] ..... B65D 75/04; B65D 5/50

[52] U.S. Cl. ..... 206/427; 206/434; 229/117.13; 229/137

[58] Field of Search ..... 206/427, 429, 206/433–435, 140, 193, 196; 229/117.16, 103.2, 117.13, 137, 132

[56] References Cited

U.S. PATENT DOCUMENTS

| | | | |
|---|---|---|---|
| 2,911,136 | 11/1959 | Stone | 229/117.13 |
| 2,990,997 | 7/1961 | Weiss | 206/434 |
| 4,164,286 | 8/1979 | Sutherland | 206/434 |
| 4,216,861 | 8/1980 | Oliff | 206/427 |
| 4,482,090 | 11/1984 | Milliens | 229/117.13 |
| 4,785,991 | 11/1988 | Schuster | 206/427 |
| 4,941,624 | 7/1990 | Schuster | 229/117.13 |
| 5,002,186 | 3/1991 | Cooper | 206/433 |
| 5,221,042 | 6/1993 | Oliff | 229/117.13 |
| 5,292,059 | 3/1994 | Oliff | 229/137 |

*Primary Examiner*—Bryon P. Gehman

[57] ABSTRACT

A wrap-around article carrier, comprising a bottom panel having opposing side edges and further having opposing end edges, a first side panel and an opposing second side panel, and a top panel having opposing side edges. Each one of the side panels has a top edge and an opposing bottom edge that is connected to one of the side edges of the bottom panel. The side edges of the top panel are connected to one of the top edges of the side panels. The carrier further has a first end panel and an opposing second end panel. Each of the end panels has a bottom edge that is connected to one of the end edges of the bottom panel. The carrier further has an article holder connected to the top panel. The article holder contacts and secures the top of articles contained within the carrier.

20 Claims, 3 Drawing Sheets

WRAP-AROUND ARTICLE CARRIER

BACKGROUND OF THE INVENTION

1. Field of the Invention

The present invention relates, generally, to article carriers. More particularly, the invention relates to wrap-around article carriers formed by wrapping a flat carrier blank around a product configuration.

2. Background Information

Wrap-around article carriers are commonly used to package beverage cans and other articles. Basically, wrap-around article carriers are formed by grouping articles in an arrangement they are desired to be in after packaging to form a product configuration, and then wrapping a flat carrier blank around the product configuration. The blank is tightly drawn about the articles and the ends of the blank are connected to each other. Cutouts are often provided at the upper and lower portion of the side panels in order to grip the end portions of articles protruding through the cutouts. The cutouts allow the blank to be tightly wrapped around and to securely hold the product group. Wrap-around article carriers are economical to make and use because they typically use a smaller amount of paperboard than other cartons, and because they are stored and transported as a flat carrier blank rather than as a carton sleeve. Furthermore, wrap-around article carriers are sturdy and are well-accepted by the public.

The state of the art is believed to have limitations and shortcomings. Wrap-around article carriers by their nature have been limited as to the number of articles they can hold before articles will spill out of the open ends of the article carrier. Normally, articles are arranged in two adjacent rows allowing the sides of the carrier to engage the outer portions of all of the articles in the carrier while the inner portions of the articles abut against each other. The end portions of the articles extend through the cutouts in the side panel, which prevent the articles from spilling through the open ends of the carrier. If three rows of articles were to be packaged in one of these wrap-around article carriers, the articles in the middle row would not be in contact with the carrier, but would be held in place only by the pressure exerted by adjacent articles in the adjacent outer rows. Therefore, attempting to package a three-row product group using a typical known wrap-around article carriers increases the risk of the articles spilling out through the open ends of the carrier. Because this type of wrap-around article carriers normally can accommodate only two rows of articles, the number of articles that can be packaged is governed to a large extent by the desirable length of the package. Packages containing six articles are the most common, although packages containing eight articles can also be conveniently handled. Packages containing more than eight articles are not convenient to handle.

U.S. Pat. No. 5,611,431, assigned to Applicant's assignee, shows a wrap-around article carrier for packaging three rows of articles. The '431 carrier is capable of conveniently packaging large numbers of articles, including product configurations of up to twenty-four. A separate reinforcement strip having clip-type support panels is glued to the underside of the top panel of the carrier. These support panels support the articles of the middle row and prevent the end articles from spilling through the open ends of the carrier. The reinforcement strip also helps form a two-ply handle for the carrier.

Applicant's invention provides a wrap-around article carrier which is believed to constitute an improvement over the known art.

BRIEF SUMMARY OF THE INVENTION

The present invention provides a wrap-around article carrier which generally comprises opposing side panels foldably connected to both a bottom panel and a top panel. Opposing lower end panels are likewise foldably connected to the bottom panel and are further foldably connected to the side panels via tabs, and opposing upper end panels are foldably connected to the top panel and are further connected to the side panels via gussets. The upper end panels are formed and held in place by sandwiching the gussets between the product configuration and the side panels. The combined height of the opposing upper and lower end panels is preferably less than the height of the side panels in order to save paperboard. The side panels have a top margin or bevel panel section formed by a score line, and further have cutouts in the side panels to help secure the articles in the carrier. The top panel of the carrier is formed from a glue or first top panel and a second top panel that overlaps and is attached to the first top panel. The upper and lower end panels eliminate the need for a separate article holder to secure the tops of the articles in the carrier. The end panels and the cutouts work together to hold the articles within the carrier and allow the carrier to hold larger product configurations.

The wrap-around article carrier of the present invention secures articles within the carrier by including upper and lower end panels. The upper panels are attached to the side panels via gussets, each comprising both a web panel and a side flap, to simplify the construction of the carrier. The lower end panels are attached to the side panels via tabs.

The features, benefits and objects of this invention will become clear to those skilled in the art by reference to the following description, claims and drawings.

DETAILED DESCRIPTION

Figure 1:
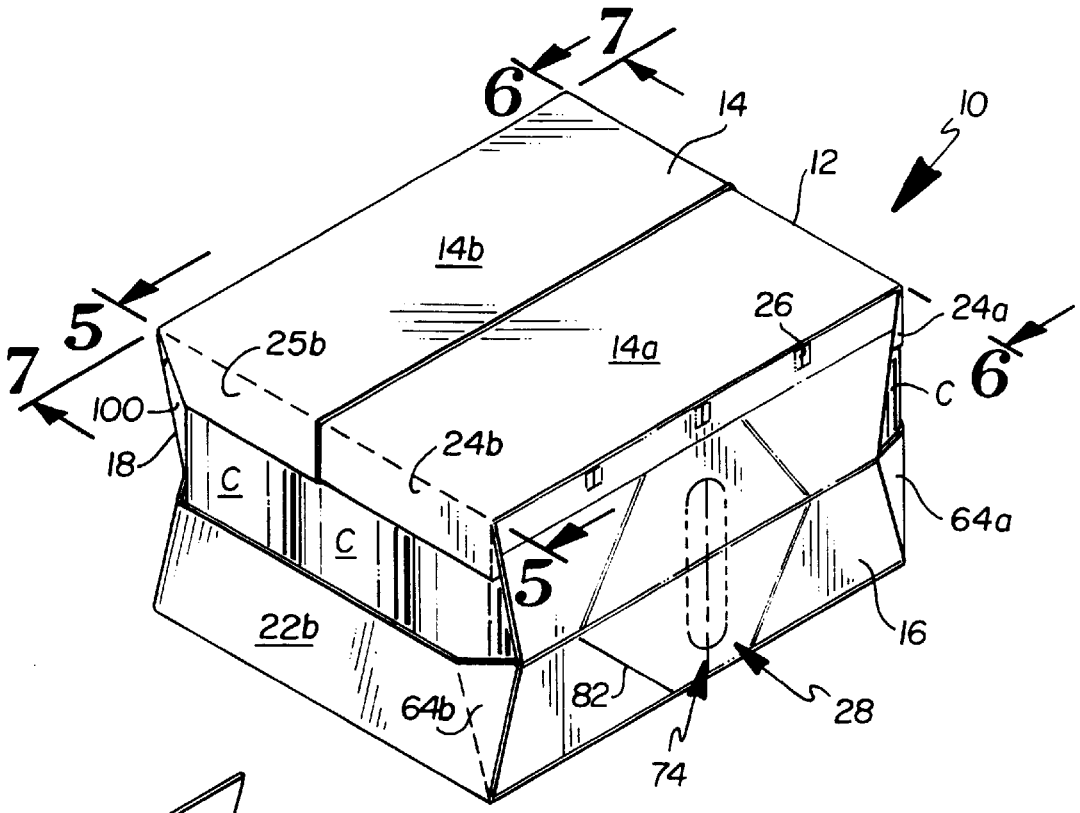
FIG. 1 is a perspective view of a wrap-around article carrier of the present invention.

Referring to FIG. 1, a package 10 is comprised of a wrap-around article carrier 12 and twelve beverage cans C contained within the carrier. The twelve cans form a product configuration of three adjacent rows by four adjacent columns. The carrier 12 includes a top panel 14 connected to side panels 16 and 18, which in turn are connected to a bottom panel 20, shown in FIGS. 2–3. The carrier 12 further includes lower end panels 22*a* and 22*b* that are foldably connected to the bottom panel 20 and the side panels 16 and 18 by tabs, and upper end panels 24*a*, 24*b*, 25*a* and 25*b* that are foldably connected to the top panel 14. Cutouts 26 in the upper portion of the side panels 16 and 18 are located between adjacent columns of the cans.

Figure 2:
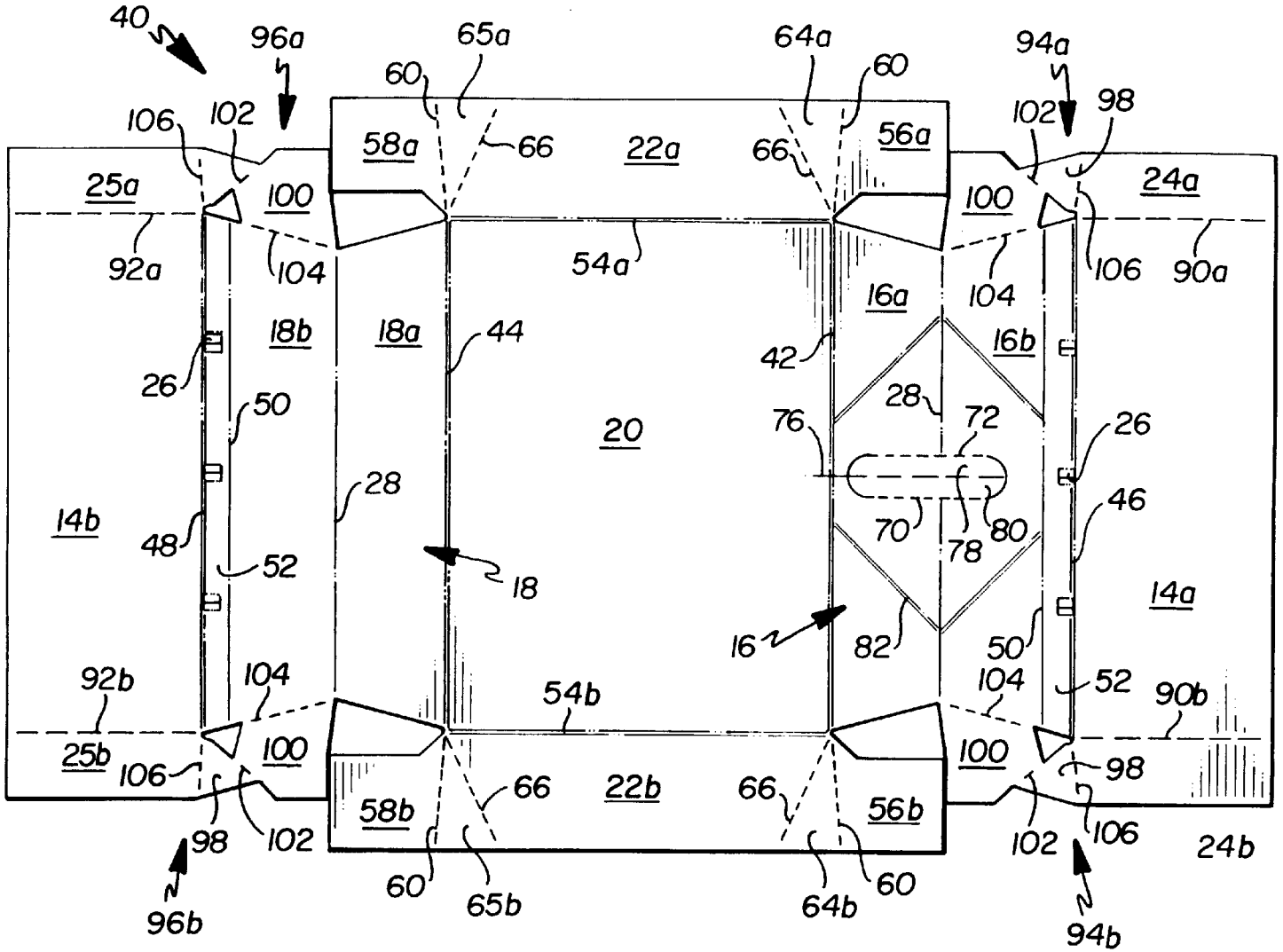
FIG. 2 is a plan view of a blank for forming the main wrap-around portion of the carrier of FIG. 1.
Figure 4:
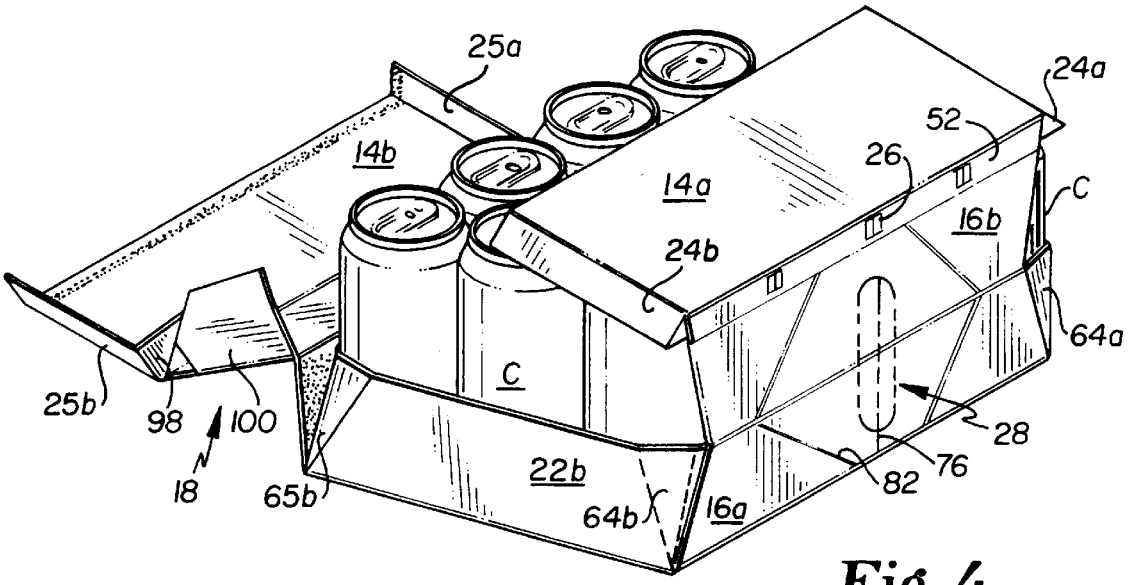
FIG. 4 is perspective view of a partially constructed carrier of FIG. 3 after the side panels and first top panel have been folded into place.

Referring to FIG. 2, a primary blank 40 for forming the wrap-around article carrier 12 shown in FIG. 1 is a generally rectangular sheet of paperboard or other material having sufficient strength and flexibility to be folded into place and function as a carrier 12. Bottom panel section 20 is connected by fold line 42 to side panel section 16 and by fold line 44 to side panel section 18. The side panel section 16 is connected to a glue or top panel flap 14*a* by fold line 46, and the side panel section 18 is connected to a top panel flap 14*b* by fold line 48. The top panel flap 14*b* overlaps and is glued to the top panel flap 14*a* to form the top panel 14 shown in FIG. 1. Fold lines 50 are spaced a short distance from fold lines 46 and 48 to form bevel panel sections or top margins 52. The cutouts 26 are formed within the margins 52. The cutouts 26 are preferably formed by an I-shaped cut which form two tabs that fold about vertical lines into the carrier 12 and away from each other. The cutouts 26 on each side panel are spaced at intervals along the margins 52 that allow the tabs to extend between adjacent columns of cans C and help secure the cans within the carrier. The cans do not extend through the cutouts. The top margins 52 allow the side panels 16 and 18 to conform to the shape of the top of the cans, particularly when the carrier 12 is undergoing lifting stresses. The side panels 16 and 18 are preferably divided into lower side panels 16*a* and 18*a* and upper side panels 16*b* and 18*b* by fold line 28. The height of the lower side panels 16*a* and 18*a* preferably corresponds to the height of the lower end panels 22*a* and 22*b*.

The bottom panel section 20 is connected to a lower end panel flap 22*a* by fold line 54*a* and to a lower end panel flap 22*b* by fold line 54*b*. First tabs 56*a* and 56*b* connect both lower end panel flaps 22*a* and 22*b* to the first side panel section 16, and second tabs 58*a* and 58*b* connect both lower end panels 22*a* and 22*b* to the second side panel 18. The tabs 56*a*, 56*b*, 58*a*, 58*b* are foldably connected to the side panels 16 and 18 by fold lines 60. Each of the end panels 22*a* and 22*b* includes a first bevel portion 64*a* and 64*b* and a second bevel portion 65*a* and 65*b*. Each of the bevel portions 64*a*, 64*b*, 65*a* and 65*b* within the end panels 22*a* and 22*b* are defined by a fold line 66. The first bevel portions 64*a* and 64*b* are connected to the first tabs 56*a* and 56*b* and the second bevel portions 65*a* and 65*b* are connected to the second tabs 58*a* and 58*b* at fold lines 60. The fold lines 62 and 66 are oriented and arranged to cause the tabs 56*a*, 56*b*, 58*a* and 58*b* to fold adjacent to one of the side panels 16 and 18.

The top panel flap 14*a* is connected to an upper end panel flap 24*a* by fold line 90*a* and to an upper end panel flap 24*b* by fold line 90*b*. Similarly, the top panel flap 14*b* is connected to an upper end panel flap 25*a* by fold line 92*a* and to an upper end panel flap 25*b* by a fold line 92*b*. First gussets 94*a* and 94*b* connect both upper end panel flaps 24*a* and 24*b* to the first side panel section 16, and second gussets 96*a* and 96*b* connect both upper end panel flaps 25*a* and 25*b* to the second side panel section 18. Each of the gussets 94*a*, 94*b*, 96*a* and 96*b* has a web panel 98 foldably connected to a side flap 100 by fold line 102. The side flaps 100 are foldably connected to the upper side panels 16*b* and 18*b* by fold lines 104. The web panels 98 are foldably connected to the upper end panels 24*a*, 24*b*, 25*a* and 25*b* by fold lines 106. The fold lines 102, 104 and 106 are oriented and arranged to cause the web panels 98 and side flaps 100 to fold adjacent to each other along the inside of one of the side panels 16 and 18, and to fold the upper end panels 24*a*, 24*b*, 25*a* and 25*b* down into position. The product configuration sandwiches the web panels 98 and the side flaps 100 between one of the side panels 16 and 18 and an article or can C within the product configuration, and thus maintains the upper end panel flaps 24*a*, 24*b*, 25*a* and 25*b* in position without the extra step of adhering the gussets 94*a*, 94*b*, 96*a* and 96*b* to the side panels 16 and 18 and upper end panel flaps 24*a*, 24*b*, 25*a* and 25*b*.

A handle 28, shown in FIG. 1, is formed by creating an opening in the side panel section 16. The handle 28 is defined by a perforated edge 70 and a fold line 72 which create a tab 74 that folds into the carrier. A score line 76 dissects the tab 74 into a beveled portion 78 and a distal portion 80, and extends a short distance into the bottom panel section 20. The beveled portion 78 and distal portion 80 of the tab 74 follow the cylindrical contour of a can in the carrier. The side panel section 16 has a pattern of stress-reducing score lines 82 which are positioned around the handle 28 and extend a short distance into the bottom panel section 20. These score lines 82 distribute the stresses that occur when the package 10 is lifted by the handle 28.

Figure 3:
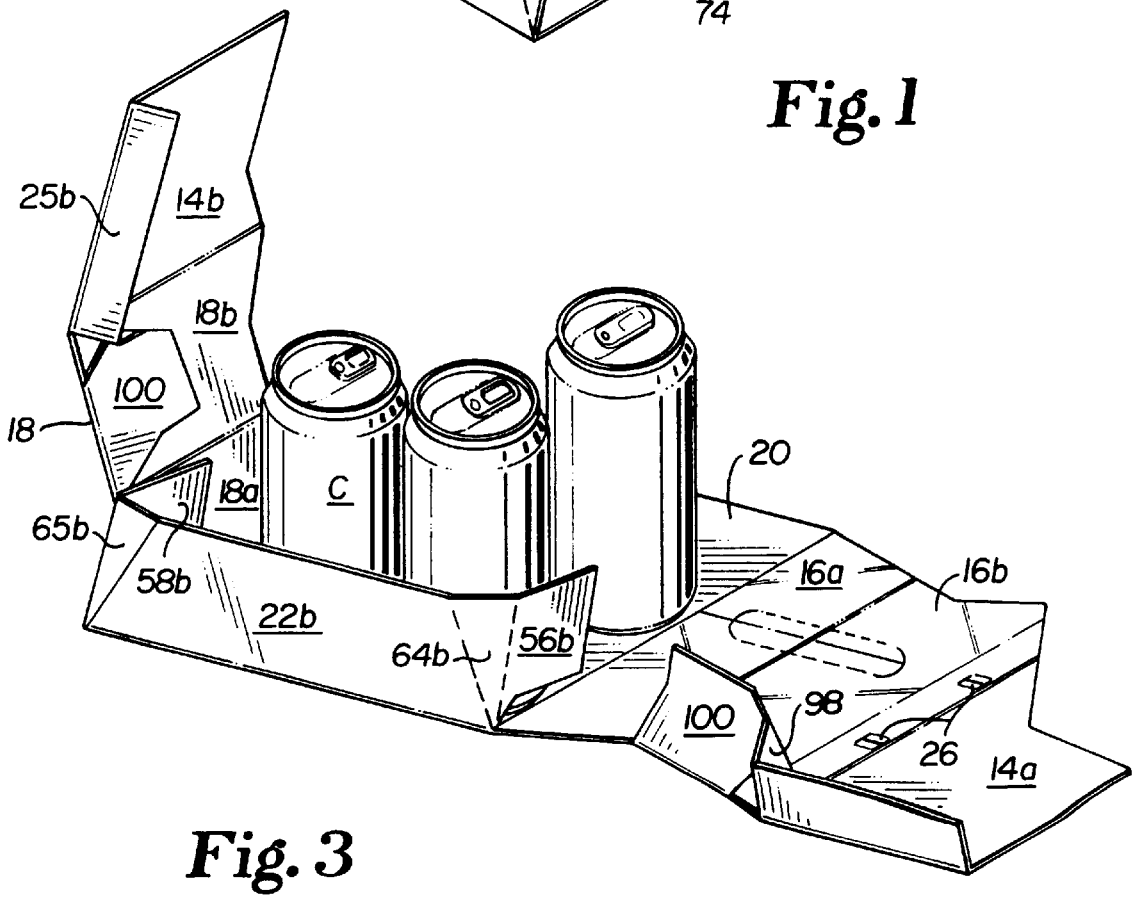
FIG. 3 is a perspective view illustrating a lower end panel and a side panel of the blank of FIG. 2 being folded around an article group.
Figure 5:
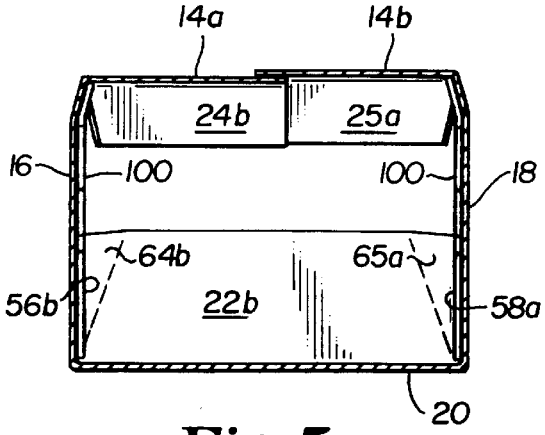
FIG. 5 is a partial cross-sectional view along line 5—5 of FIG. 1.
Figure 6:
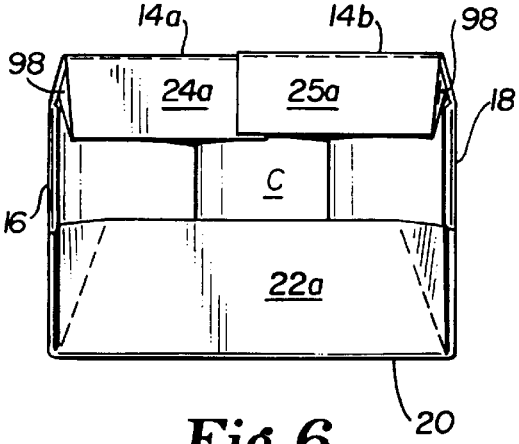
FIG. 6 is an end view taken along line 6—6 of FIG. 1.
Figure 7:
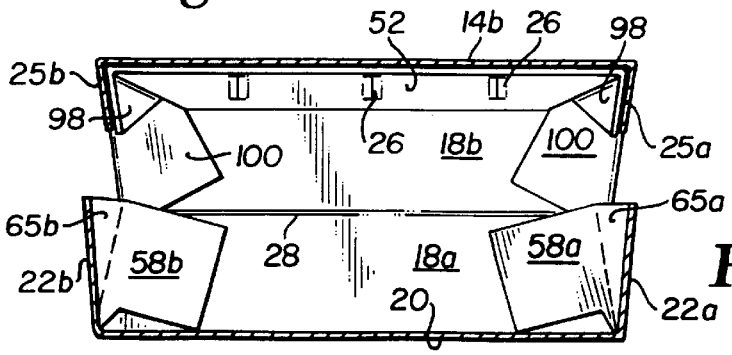
FIG. 7 is a cross-sectional view taken along line 7—7 of FIG. 1.

To form a package 10 from the blank 40, twelve beverage cans are arranged into a product configuration comprising three rows and four columns as illustrated in FIG. 3, and are positioned on the bottom panel section 20. The blank 40 is schematically shown in FIG. 3 as being positioned in a partially folded condition, wherein the end panel 22*b* has been folded upward and the tabs 56*b* and 58*b* are folded along the product configuration. The side panels 16 and 18 are folded up to sandwich the tabs 56*a*, 56*b*, 58*a* and 58*b* between the side panels and the product configuration. The tabs are preferably adhered to the inside of the lower side panels 16*a* and 18*a* using glue. The side flaps 100 of the gussets are folded against the inside of the upper side panels 16*b* and 18*b*. The gussets pull the upper end panels 24*a*, 24*b*, 25*a* and 25*b* down. The top panel 14*a* is folded over the cans C. Glue is applied, to the stippled areas shown in FIG. 5 for example, and the top panel 14*b* is folded over and adhered onto the top panel 14*a* to form the carrier 12 illustrated in FIGS. 1 and 6. The upper end panels 24*a*, 24*b*, 25*a* and 25*b* of a formed carrier 12 are held in place because the gussets 94*a*, 94*b*, 96*a* and 96*b* are sandwiched between the side panels 16 and 18 and the product configuration. The upper end panels cannot fold up unless the relatively ridged side flaps 100 bend. Thus, the gussets do not have to be adhered to the upper end panels or to the side panels.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A carrier, comprising:

(a) a bottom panel having opposing side edges;

(b) a first side panel and an opposing second side panel, each of said side panels having a top edge and an opposing bottom edge, said bottom edge of each of said side panels being connected to one of said side edges of said bottom panel;

(c) a top panel having opposing side edges, each of said side edges of said top panel being connected to one of said top edges of said side panels said top panel including a first top panel flap and a second top panel flap, each of said top panel flaps having opposing end edges, said carrier further comprising opposing first upper end panels and opposing second upper end panels, each of said upper end panels having a top edge, said top edge of each of said first upper end panels being connected to one of said end edges of said first top panel flap, said top edge of each of said second upper end panels being connected to one of said end edges of said second top panel flap; and (d) four gussets, each of said gussets foldably connecting one of said upper end panels to one of said side panels.

2. The carrier of claim 1, wherein said first side panel further has a handle opening.

3. The carrier of claim 2, wherein said first side panel further has a plurality of stress-relieving score lines.

4. The carrier of claim 1, wherein said carrier contains a product formation defined by adjacent rows and adjacent columns of articles, said side panels having at least one cutout, said at least one cutout having opposing tabs, said at least one cutout being aligned between adjacent columns of articles.

5. The carrier of claim 4, wherein said at least one cutout is positioned within a top margin of each of said side panels.

6. The carrier of claim 5, wherein said top margin of each of said side panels is a bevel panel section formed by fold lines between said top panel and each of said side panels and a score line in each of said side panels.

7. The carrier of claim 1, wherein each of said first and second side panels have a lower panel connected to an upper panel by a fold line.

8. The carrier of claim 1, wherein said bottom panel has opposing end edges, said carrier further comprising a first lower end panel and an opposing second lower end panel, each of said lower end panels having a bottom edge, said bottom edge of each of said lower end panels being connected to one of said end edges of said bottom panel.

9. The carrier of claim 8, further including a first tab and a second tab foldably connected to each of said first and second lower end panels, said first tabs being attached to said first side panel and said second tabs being attached to said second side panel.

10. The carrier of claim 9, wherein each of said lower end panels has a first bevel panel portion foldably connected to said first tab and a second bevel panel portion foldably connected to said second tab, each of said bevel portions being defined within said end panels by a fold line.

11. The carrier of claim 1, wherein each of said gussets includes a side flap foldably connected to a web panel at a first fold line, said web panel being foldably connected to one of said top panel flaps at a second fold line, said side flap being foldably connected to one of said side panels at a third fold line.

12. The carrier of claim 11, wherein said side flap is folded about said third fold line to be adjacent to said side panel and said web panel is folded about said first fold line to be adjacent to said side flap.

13. The carrier of claim 1, wherein said carrier contains twelve articles in a product configuration of three rows by four columns.

14. A wrap-around beverage can carrier for containing a product formation defined by adjacent rows and adjacent columns of cans, comprising:

(a) a bottom panel having opposing side edges and opposing end edges;

(b) a first side panel and an opposing second side panel, each of said side panels having a top edge and an opposing bottom edge, said bottom edge of each of said side panels being connected to one of said side edges of said bottom panel, said first side panel having a handle opening, said side panels having at least one cutout, said at least one cutout having opposing tabs, said at least one cutout being aligned between adjacent columns of cans;

(c) a top panel including a first top panel flap and a second top panel flap, said first top panel flap having a side edge attached to said top edge of said first side panel, said second top panel having a side edge attached to said top edge of said second side panel, said second top panel being overlapped and attached to said first top panel, each of said top panel flaps having opposing end edges;

(d) a first lower end panel and an opposing second lower end panel, each of said lower end panels having a bottom edge, said bottom edge of each of said lower end panels being connected to one of said end edges of said bottom panel;

(e) a first tab and a second tab foldably connected to each of said first and second lower end panels, said first tabs being attached to said first side panel and said second tabs being attached to said second side panel, each of said lower end panels having a first bevel panel portion foldably connected to said first tab and a second bevel panel portion foldably connected to said second tab, each of said bevel portions being defined within said end panels by a fold line;

(f) a pair of opposing first upper end panels and a pair of opposing second upper end panels, each of said upper end panels having a top edge, said top edge of each of said first upper end panels being connected to one of said end edges of said first top panel flap, said top edge of each of said second upper end panels being connected to one of said end edges of said second top panel flap; and (g) four gussets, each of said gussets foldably connecting one of said upper end panels to one of said side panels, each of said gussets including a side flap foldably connected to a web panel at a first fold line, said web panel being foldably connected to one of said top panel flaps at a second fold line, said side flap being foldably connected to one of said side panels at a third fold line.

15. A flat blank for forming an article carrier, comprising:

(a) a bottom panel having opposing side edges and opposing end edges;

(b) a first side panel and an opposing second side panel, each of said side panels having a top edge and an opposing bottom edge, said bottom edge of each of said side panels being connected to one of said side edges of said bottom panel;

(c) a first top panel flap and a second top panel flap, said first top panel flap having a side edge attached to said top edge of said first side panel, said second top panel flap having a side edge attached to said top edge of said second side panel, said second top panel flap adapted to be overlapped and attached to said first top panel flap in an article carrier formed from said flat blank, each of said top panel flaps having opposing end edges;

(d) opposing first upper end panels and opposing second upper end panels, each of said upper end panels having a top edge, said top edge of each of said first upper end panels being foldably connected to one of said end edges of said first top panel flap, said top edge of each of said second upper end panels being foldably connected to one of said end edges of said second top panel flap; and (e) four gussets, each of said gussets foldably connecting one of said upper end panels to one of said side panels, each of said gussets including a side flap foldably connected to a web panel at a first fold line, said web panel being foldably connected to one of said top panel flaps at a second fold line, said side flap being foldably connected to one of said side panels at a third fold line.

16. The flat blank of claim 15, wherein said first side panel has a handle opening.

17. The flat blank of claim 15, wherein said side panels have at least one cutout adjacent to said top edge, said at least one cutout having opposing tabs.

18. The flat blank of claim 15, further comprising a first lower end panel and an opposing second lower end panel, each of said lower end panels having a bottom edge, said bottom edge of each of said lower end panels being connected to one of said end edges of said bottom panel.

19. The flat blank of claim 18, further comprising a first tab and a second tab foldably connected to each of said first and second lower end panels, said first tabs being attached to said first side panel in an article carrier formed from said flat blank, said second tabs being attached to said second side panel in an article carrier formed from said flat blank, each of said lower end panels having a first bevel panel portion foldably connected to said first and a second bevel panel portion foldably connected to said second tab, each of said bevel portions being defined within said end panels by a fold line.

20. A flat carrier blank for forming a beverage can carrier, comprising:

(a) a bottom panel having opposing side edges and opposing end edges;

(b) a first side panel and an opposing second side panel, each of said side panels having a top edge and an opposing bottom edge, said bottom edge of each of said side panels being connected to one of said side edges of said bottom panel, said side panels having at least one cutout adjacent to said top edge, said at least one cutout having opposing tabs;

(c) a first top panel flap and a second top panel flap, said first top panel flap having a side edge attached to said top edge of said first side panel, said second top panel flap having a side edge attached to said top edge of said second side panel, said second top panel flap adapted to be overlapped and attached to said first top panel flap in a beverage can carrier formed from said flat carrier blank, each of said top panel flaps having opposing end edges;

(d) a first lower end panel and an opposing second lower end panel, each of said lower end panels having a bottom edge, said bottom edge of each of said lower end panels being connected to one of said end edges of said bottom panel;

(e) a first tab and a second tab foldably connected to each of said first and second lower end panels, said first tabs being attached to said first side panel in a beverage can carrier formed from said flat carrier blank, said second tabs being attached to said second side panel in a beverage can carrier formed from said flat carrier blank, each of said lower end panels having a first bevel panel portion foldably connected to said first tab and a second bevel panel portion foldably connected to said second tab, each of said bevel portions being defined within said end panels by a fold line;

(f) opposing first upper end panels and opposing second upper end panels, each of said upper end panels having a top edge, said top edge of each of said first upper end panels being foldably connected to one of said end edges of said first top panel flap, said top edge of each of said second upper end panels being foldably connected to one of said end edges of said second top panel flap; and (g) four gussets, each of said gussets foldably connecting one of said upper end panels to one of said side panels, each of said gussets including a side flap foldably connected to a web panel at a first fold line, said web panel being foldably connected to one of said top panel flaps at a second fold line, said side flap being foldably connected to one of said side panels at a third fold line.

* * * * *